US006394741B1

(12) United States Patent
Lehtimaki

(10) Patent No.: US 6,394,741 B1
(45) Date of Patent: May 28, 2002

(54) APPARATUS FOR STACKING SHEETS

(75) Inventor: Teuvo Lehtimaki, Lahti (FI)

(73) Assignee: Valmet Panelhandling OY, Nastola (FI)

( * ) Notice: Subject to any disclaimer, the term of this patent is extended or adjusted under 35 U.S.C. 154(b) by 0 days.

(21) Appl. No.: 09/508,063

(22) PCT Filed: Oct. 6, 1998

(86) PCT No.: PCT/FI98/00780

§ 371 Date: Aug. 28, 2000

§ 102(e) Date: Aug. 28, 2000

(87) PCT Pub. No.: WO99/18023

PCT Pub. Date: Apr. 15, 1999

(30) Foreign Application Priority Data

Oct. 8, 1997 (FI) ..... 973906

(51) Int. Cl.[7] ..... B65H 31/32

(52) U.S. Cl. ..... 414/790.8; 414/793.4; 271/218

(58) Field of Search ..... 414/793.4, 790.8; 271/218, 158

(56) References Cited

U.S. PATENT DOCUMENTS

| | | | | |
|---|---|---|---|---|
| 2,958,527 A | * | 11/1960 | Seel | 271/158 |
| 3,894,638 A | | 7/1975 | Hovekamp | |
| 3,902,711 A | * | 9/1975 | Lenoir et al. | 271/218 |
| 4,162,649 A | * | 7/1979 | Thornton | 271/218 |
| 4,902,195 A | | 2/1990 | Lucas | |
| 4,927,321 A | | 5/1990 | Lucas | |
| 5,375,695 A | | 12/1994 | Daringer et al. | |
| 5,413,324 A | | 5/1995 | Flade | |
| 5,478,638 A | | 12/1995 | Springer et al. | |
| 5,672,045 A | * | 9/1997 | Schmid et al. | 414/790.8 |

FOREIGN PATENT DOCUMENTS

| | | | | |
|---|---|---|---|---|
| DE | 34-34115 A1 | | 4/1986 | |
| EP | 0470362 | | 2/1992 | |
| JP | 0048148 | * | 4/1980 | 271/218 |
| JP | 405097317 A | * | 4/1993 | 271/218 |

* cited by examiner

*Primary Examiner*—H. Grant Skaggs
(74) *Attorney, Agent, or Firm*—Birch, Stewart, Kolasch & Birch, LLP

(57) ABSTRACT

The invention relates to an apparatus for stacking at least two sheets, an apparatus comprising a vertically movable stacking platform and an intermediate support member with a width advantageously essentially equal to that of a stacking platform. The intermediate support member is adapted movable into a position above the stacking platform or above a stack of at least one sheet placed on the platform and over which intermediate support member the next sheet or sheet substack is brought and which intermediate support member is then retracted from between the overlying sheets, whereby the sheets are simultaneously aligned against a back gage. The intermediate support member is made from a flexible multilayer material having at least one layer made from a material having a substantially high tear resistance.

9 Claims, 1 Drawing Sheet

APPARATUS FOR STACKING SHEETS

This application is the national phase under 35 U.S.C. §371 of PCT International Application No. PCT/FI98/00780 which has an International filing date of Oct. 6, 1998, which designated the United States of America.

BACKGROUND OF THE INVENTION

1. Field of the Invention

The present invention relates to an apparatus for stacking at least two sheets.

2. Description of Background Art

Apparatuses of the type concerned in the invention are used for stacking sheet substacks at least one sheet thick into higher stacks. From the prior art are known embodiments utilizing a carrier means similar to a conveyor band as an intermediate support member at a stacking station. These conventional arrangements are hampered by a number of drawbacks including, among others, an inferior resistance of the material used in their intermediate support member to pointed/edged mechanical stress, which tends to cause tearing and cutting of the support means surface. Moreover, the conveyor material has in certain situation been able to mar the sheet material being stacked.

SUMMARY AND OBJECTS OF THE INVENTION

It is an object of the present invention to provide an apparatus capable of overcoming the disadvantages of the above-described prior-art embodiments.

The embodiment of the invention is characterized by what is stated in the appended claims.

An apparatus according to the invention offers a number of significant benefits. The structure of the intermediate support member used in the apparatus provides an extremely durable construction. The multilayer structure of the intermediate support member has a very good wear resistance. It is also resistant against cutting. Its soft outer layers are incapable of marring the sheets being stacked. Furthermore, its the felt-like surface texture complies to the small surface irregularities of the stacked sheets. Moreover, the apparatus is capable of making extremely neat stacks. The stack edges become straight as the intermediate support member can push the transferred stacks of sheets very reliably against a back gage.

BRIEF DESCRIPTION OF THE DRAWINGS

In the following the invention will be examined in greater detail with reference to the appended drawings, in which.

BRIEF DESCRIPTION OF THE PREFERRED EMBODIMENTS

Figure 2:
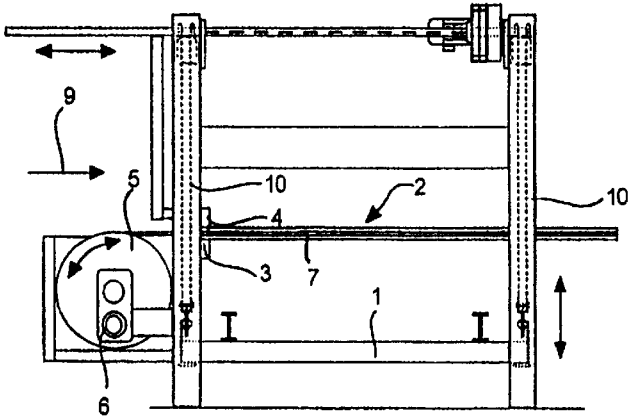
FIG. 2 shows an apparatus according to the invention in an end view.
Figure 4:
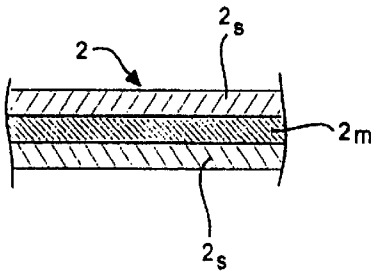
FIG. 4 shows the structure of the intermediate support member used in the apparatus according to the invention schematically in sectional view.
Figure 1:
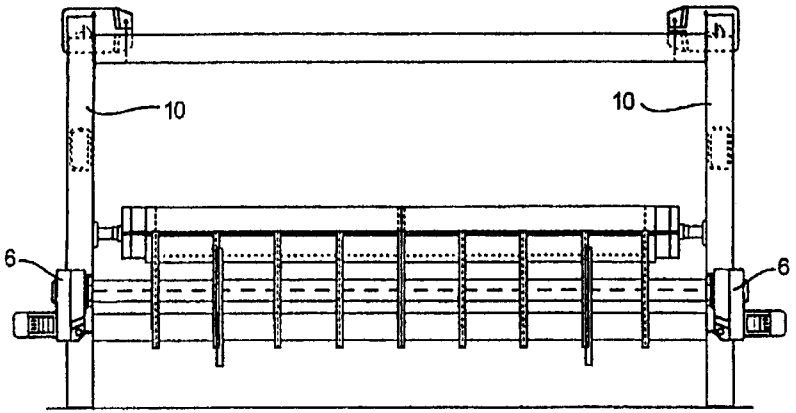
FIG. 1 shows an apparatus according to the invention in a side view.
Figure 3:
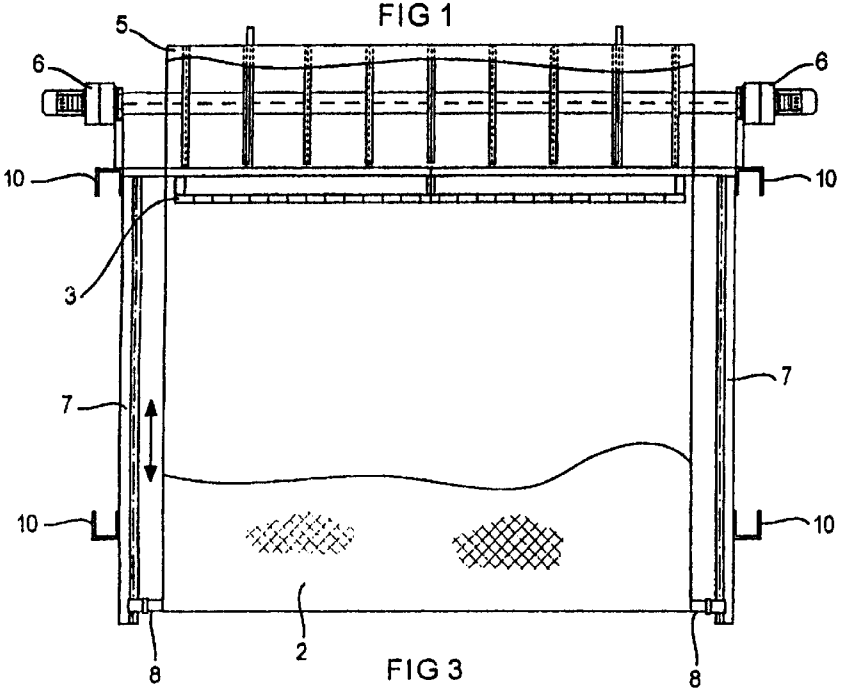
FIG. 3 shows an apparatus according to the invention in a top view.

Referring to the diagrams, the apparatus according to the invention shown therein comprises a framework 10 having a vertically movable platform 1 adapted thereto. The apparatus includes an intermediate support member 2 adapted to be movable into a position above the stacking platform 1 or above a stack of at least one sheet placed on said platform. The width of the intermediate support member 2 is advantageously made essentially equal to the width of the stacking platform 1. The next sheet or substack of sheets is brought on the intermediate support member 2 by means of, e.g., a pusher 4. The function of the intermediate support member is to make the transfer of sheets onto the underlying stack of sheets easier and to protect the substacks of sheets from marring each other. When the intermediate support member 2 is removed from between the stacked sheets, the sheets are allowed to rest on each other simultaneously as they are pushed at least by their one edges against a back gage 3, 4. The pusher 4 can act as a back gage during the retraction of the intermediate support member. The apparatus also includes means 5, 6, 7, 8 for moving the intermediate support member to above the stacking platform 1 and retracting the same from between the sheets. The intermediate support member 2 is connected by its one end to a support roller element 5, whose driven rotation by a drive means 6 forces the intermediate support member 2 to retract in a winding manner from the stacking area of the sheets. The apparatus further includes guides 7 along which the movable intermediate support member is adapted to run. The guides serve to support carriages 8 to which the intermediate support member 2 is connected, e.g., by its edges.

The sheets or sheet substacks to be stacked are fed from the direction of arrow 9 marked in FIG. 2 by means of the pusher 4 onto the stacking platform 1 or an intermediate support member 2 driven over the stack of sheets already stacked on the platform. When the new substack of sheets is fully pushed home in the stacking station, the intermediate support member 2 is removed from the gap remaining between the stacked sheets by actuating the roller element 5 to wind the intermediate support member away via the slot between the pusher 4 and the back gage 3. Then, the upper part of the lower substack is supported by the back gage 3, while at least the lower part of the upper substack is supported by the pusher 4 which is located in essentially the same plane with the back gage. Next, the platform 1 is lowered and the intermediate support member 2 is driven above the sheet stack resting in the stacking area, whereby a new sheet substack can be transferred onto the intermediate support member.

The intermediate support member 2 is made from a multilayer material having at least one layer 2*m* of a material having a substantially high tear resistance. Furthermore, at least one surface layer 2*s* of the member is made from a soft material.

The surface layer 2*s* of the intermediate support member 2 may be made from, e.g., a felt-like material. At least one inner layer 2*m* of the intermediate support member 2 is made from a fabric of substantially high tear resistance such as a metallic fabric. One advantageous choice for the middle layer is a metal wire fabric.

The intermediate support member 2 typically comprises two surface layers 2*s* and one inner layer 2*m*. The surface layer 2*s* is of a felted-surface polymer fabric such as a polyester-resin-bonded fabric.

Advantageously, the intermediate support member 2 is made from a flexible material, whereby it can be rolled about the support roller element.

The layers 2*s*, 2*m* are bonded to each other by glueing. Also other similar bonding methods may be used.

In a typical application, the dimensions of the intermediate support member over the stacking area are about 2–4 m wide by 5–9 m long. The thickness of the layers in the intermediate support member are determined by the material used. The surface layers may have a thickness in the order of 2–3 mm, while the middle layer is typically not thicker than 1 mm. Obviously, the dimensions of the intermediate support member may depending on the application vary even in a wide range from the above-cited typical figures.

The invention also concerns an intermediate support member alone particularly suited for use in a stacking apparatus of the type described above. Then, the intermediate support member 2 is made from a multilayer material in which at least one surface layer 2*s* is made from a soft material and at least one second layer 2*m* of a material having a high tear resistance.

The apparatus and intermediate support member according to the invention may be used in applications related to the sheet-manufacturing industry in conjunction with, e.g., a trim-sawing line of sheets.

To those versed in the art it is obvious that the invention is not limited by the exemplifying embodiments described above.

What is claimed is:

1. An apparatus for stacking at least two sheets, said apparatus comprising a vertically movable stacking platform and an intermediate support member with a width advantageously essentially equal to that of said stacking platform, which intermediate support member is adapted movable into a position above the stacking platform or above a stack of at least one sheet placed on said platform and over which intermediate support member the next sheet or sheet substack is brought and which intermediate support member is then retracted from between the overlying sheets, whereby the sheets are simultaneously aligned against a back gage wherein, said intermediate support member is made from a flexible multilayer material having at least one layer made from a material having a substantially high tear resistance, and wherein said intermediate support member is rolled about a support roller element when it is retracted.

2. An apparatus as defined in claim 1, characterized in that at least one surface layer is made from a soft material for protecting the sheets from marring each other during stacking.

3. An apparatus as defined in claim 1 characterized in that a surface layer of said intermediate support member is made from a felt-like material for protecting the sheets from marring each other during stacking.

4. An apparatus as defined in claim 1 characterized in that at least one inner layer of said intermediate support member is made from a fabric of substantially high tear resistance such as a metallic fabric.

5. An apparatus as defined in claim 1, characterized in that said intermediate support member (2) comprises two surface layers (2*s*) and one middle layer (2*m*).

6. An apparatus as defined in claim 1 characterized in that a surface layer is made from a felted-surface polymer fabric for protecting the sheets from marring each other during stacking.

7. An apparatus as defined in claim 1, characterized in that said layers (2*s*, 2*m*) are bonded to each other by glueing.

8. An intermediate support member for use in an apparatus defined in claim 1, characterized in that said intermediate support member (2) is made from a multilayer material having at least one layer (2*m*) of a material having a substantially high tear resistance.

9. An intermediate support member as defined in claim 8, characterized in that at least one surface layer is made from a soft material for protecting the sheets from marring each other during stacking.

* * * * *